US007730862B2

(12) United States Patent
Tanabe et al.

(10) Patent No.: US 7,730,862 B2
(45) Date of Patent: Jun. 8, 2010

(54) VALVE MECHANISM FOR INTERNAL COMBUSTION ENGINE

(75) Inventors: Mikio Tanabe, Tokyo (JP); Shinichi Murata, Tokyo (JP); Masaru Mori, Tokyo (JP); Yusuke Kido, Tokyo (JP)

(73) Assignee: Mitsubishi Jidosha Kogyo Kabushiki Kaisha, Tokyo (JP)

( * ) Notice: Subject to any disclaimer, the term of this patent is extended or adjusted under 35 U.S.C. 154(b) by 20 days.

(21) Appl. No.: 11/886,670

(22) PCT Filed: Apr. 14, 2005

(86) PCT No.: PCT/JP2005/007248

§ 371 (c)(1),
(2), (4) Date: Sep. 19, 2007

(87) PCT Pub. No.: WO2006/112018

PCT Pub. Date: Oct. 26, 2006

(65) Prior Publication Data

US 2009/0020087 A1 Jan. 22, 2009

(51) Int. Cl.
*F01L 1/18* (2006.01)

(52) U.S. Cl. ..... 123/90.39; 123/90.16

(58) Field of Classification Search ..... 123/90.15, 123/90.16, 90.39

See application file for complete search history.

(56) References Cited

U.S. PATENT DOCUMENTS

| | | | |
|---|---|---|---|
| 6,484,681 | B2 | 11/2002 | Kuroda et al. |
| 7,107,953 | B2 | 9/2006 | Takayasu et al. |
| 2004/0016413 | A1 | 1/2004 | Murata et al. |

FOREIGN PATENT DOCUMENTS

| | | | |
|---|---|---|---|
| CN | 1598251 | A | 3/2005 |
| JP | 2002-70517 | A | 3/2002 |
| JP | 2003-343226 | A | 12/2003 |
| JP | 2003-343227 | A | 12/2003 |
| JP | 2005-90409 | A | 4/2005 |

*Primary Examiner*—Zelalem Eshete
(74) *Attorney, Agent, or Firm*—Birch, Stewart, Kolasch & Birch, LLP

(57) ABSTRACT

A valve mechanism for an internal combustion engine includes a first rocker arm (4) connected to an intake or exhaust valve and supported on a rocker shaft (3*a*), a second rocker arm (5) supported on the rocker shaft for being rotationally driven by a cam, a cylinder (10) formed on one of the first and second rocker arms (4, 5) and a first piston (11) provided in the cylinder, a contacting projection (4*a*) projecting on the other one of the first and second rocker arms, a return spring (12) for biasing the first piston in a direction in which the first piston contacts with the contacting projection, and a second piston (14) for displacing the first piston to a position at which the first piston does not contact with the contacting projection. The two pistons extend in parallel to each other when the first piston is at a non-contacting position.

6 Claims, 7 Drawing Sheets

SECTION A-A

SECTION A-A

SECTION B-B

NO LIFT (INTAKE AND EXHAUST)
EXHAUST
INTAKE
CYLINDER CUT-OFF

EXHAUST CAM
EXHAUST
LOW-SPEED CAM
INTAKE
LOW SPEED

EXHAUST CAM
EXHAUST
HIGH-SPEED CAM
INTAKE
HIGH SPEED

STRUCTURE OF
CHANGEOVER SECTION

VALVE MECHANISM FOR INTERNAL COMBUSTION ENGINE

BACKGROUND OF THE INVENTION

1. Field of the Invention

This invention relates to a valve mechanism for an internal combustion engine capable of driving an intake valve and an exhaust valve of the internal combustion engine to open and close at different driving timings in response to the driving state of the engine.

2. Description of the Related Art

In recent years, a valve mechanism (hereinafter referred sometimes as variable valve mechanism) has been developed and placed into practical use wherein the operational characteristic (opening and closing timings, open period) of an intake valve and an exhaust valve (hereinafter referred to generally as engine valves or simply as valves) provided in a reciprocating type internal combustion engine (hereinafter referred to as engine) can be changed over to an optimum characteristic in response to a load state or a speed state of the engine.

As one of mechanisms for changing over the working characteristic in such a valve mechanism as described above, for example, a mechanism has been developed wherein a low-speed cam having a cam profile suitable for a low-speed driving state of an engine and a high-speed cam having a cam profile suitable for high-speed driving of the engine are used selectively in response to the state of rotation of the engine so that the engine valves are operated between on and off (for example, refer to Patent Document 1).

An example of the structure of a conventional valve mechanism is described below with reference to FIGS. 10 to 12. As shown in FIGS. 10 and 11, two intake valves 11 and 12 and two exhaust valves 21 and 22 are provided on a cylinder head 10 above cylinders of an engine for each of the cylinders, and a valve mechanism 30 is provided in order to drive the intake valves 11 and 12 and the exhaust valves 21 and 22.

The valve mechanism 30 is formed from an intake valve driving system for driving the intake valve 11 and 12 and an exhaust valve driving system for driving the exhaust valve 21 and 22. The intake valve driving system includes a camshaft 31, cams 31*a* to 31*c* fixed to the camshaft 31, a rocker shaft 32, and rocker arms 33 to 35 supported for rocking motion on the rocker shaft 32 and rotationally driven by the cams 31*a* to 31*c*, respectively. The exhaust valve driving system includes the camshaft 31 commonly used with the intake system, cams 31*d* and 31*e* fixed to the camshaft 31, a rocker shaft 36, and rocker arms 37 and 38 (not shown in FIG. 11) supported for rocking motion on the rocker shaft 36 and rotationally driven by the cams 31*d* and 31*e*, respectively.

A variable valve mechanism 40 having a connection changeover mechanism 41 is provided at a portion of the intake valve driving system of the valve mechanism 30. The variable valve mechanism 40 is described briefly below.

Adjustment screws 33*a* and 34*a* are provided at one end of the rocker arms 33 and 34 from among the rocker arms 33 to 35 for the intake valve driving system, respectively, and stem end portions of the intake valves 11 and 12 contact with the one end of the rocker arms 33 and 34 through the adjustment screws 33*a* and 34*a*, respectively. Consequently, the intake valve 11 is opened and closed in response to the rocking motion of the rocker arm 33 and the intake valve 12 is opened and closed in response to the rocking motion of the rocker arm 34.

Further, rollers 33*b* and 34*b* are provided at the other end of the rocker arms 33 and 34, respectively. The rollers 33*b* and 34*b* contact with the low-speed cams 31*a* and 31*b* formed in the low-speed cam profile corresponding to low-speed driving of the engine, and, if the rocker arms 33 and 34 are rotationally driven in response to the low-speed cams 31*a* and 31*b*, respectively, then the intake valves 11 and 12 are opened with a characteristic suitable for low-speed driving.

On the other hand, the rocker arm (second rocker arm) 35 can contact, at a contacting projection 35*a* formed at one end thereof, with the rocker arms 33 and 34, and contacts, at a roller 35*b* formed at the other end thereof, with the high-speed cam 31*c* formed in the high-speed cam profile corresponding to high-speed driving of the engine.

Further, as shown in FIGS. 12(*a*) and 12(*b*), a cylinder 50 having an opening 53 is formed at a location at which the one end of the rocker arm 35 on the rocker arms 33 and 34 side can contact, and a piston 51 is built in the cylinder 50.

Operating oil (here, lubricating oil is used also as the operating oil) is supplied into the cylinder 50 through an oil path (communicating path) 32*b* from the rocker shaft 32 side, and, if pressure oil is supplied into the cylinder 50, then the piston 51 moves upwardly to close the opening 53 as shown in FIG. 12(*b*). On the other hand, if the pressure oil in the cylinder 50 is released to the atmosphere, then the piston 51 is moved downwardly by the biasing force of the return spring 52 to open the opening 53 as shown in FIG. 12(*a*).

Then, the connection changeover mechanism 41 for changing over the connection state between the rocker arms 33 and 34 and the rocker arm 35 is formed from such a piston 51 in the cylinder 50 as described above and an oil pressure adjustment apparatus (not shown) for adjusting the oil pressure in the cylinder 50, and the variable valve mechanism 40 is formed from the connection changeover mechanism 41 and the intake valve driving system.

According to the configuration described above, if the pressure oil in the cylinder 50 is exhausted by the oil pressure adjustment apparatus, then a space is formed in the opening 53 of the cylinder 50 [refer to FIG. 12(*a*)]. In this instance, if the rocker arm 35 is rotationally driven by the high-speed cam 31*c*, then the contacting projection 35*a* advances into the space. However, the contacting projection 35*a* does not contact with the rocker arms 33 and 34 themselves, and the rocker arm 35 exhibits a so-called miss swing state (rocker arm non-contacting state). Accordingly, the rocker arms 33 and 34 are rotationally driven in response to the individually corresponding low-speed cams 31*a* and 31*b*, and the intake valves 11 and 12 are driven to open and close with the characteristic suitable for low-speed driving (low-speed driving mode).

On the other hand, if the oil pressure in the cylinder 50 is increased by the oil pressure adjustment apparatus, then the piston 51 is placed into a contacting state wherein it is projected, and the opening 53 of the cylinder 50 is closed with the piston 51 [refer to FIG. 12(*b*)]. Accordingly, upon rocking of the rocker arm 35, the contacting projection 35*a* at the one end of the rocker arm 35 contacts with a side face (contacting face) 54 of the piston 51 to rock the rocker arms 33 and 34 through the piston 51 (rocker arm contacting state). At this time, the rocker arms 33 and 34 are rotationally driven by the rocker arm 35 to rock in response to the high-speed cam 31*c* while moving away from the low-speed cams 31*a* and 31*b* thereby to open and close the intake valves 11 and 12 with the characteristic corresponding to high-speed driving of the engine (high-speed driving mode).

Patent Document 1: Japanese Patent Laid-Open No. 2003-343226

SUMMARY OF THE INVENTION

Subject to be Solved by the Invention

Incidentally, in such a conventional technique as described above, it is required that the piston 51 have a comparatively large diameter for the reasons that a space for allowing miss swinging of the rocker arm 35 to be performed with certainty upon low-speed driving mode operation (upon rocker arm non-contacting) is necessitated, that the space for disposing therein the return spring 52 for biasing the piston 51 downwardly is necessitated, and so forth.

However, where the piston diameter is large, a large amount of oil is required upon changeover of the driving mode (particularly, upon changeover from the high-speed driving mode to the low-speed driving mode). Therefore, the changeover requires time. In addition, there is the possibility that the contacting state between the piston 51 and the contacting projection 35*a* of the rocker arm 35 may become incomplete and the piston 51 may be repelled by reactive force upon valve driving on the way of lifting of the piston 51 to cause the contacting projection 35*a* to advance into the opening thereby to change over the driving mode to the low-speed driving mode. Then, if the piston 51 is repelled in this manner, then the rocker arms 33 and 34 collide with the cams and generate hitting noise. In addition, there is the possibility that, if the impact is high, then the rollers 34*a* and 34*b* may break.

The present invention has been made in view of such subjects as described above, and it is an object of the present invention to provide a valve mechanism for an internal combustion engine wherein changeover of the driving mode can be carried out rapidly and with certainty.

Means for Solving the Subject

In order to attain the object described above, according to the present invention, there is provided a valve mechanism for an internal combustion engine, comprising, a first rocker arm linked and connected on a free end side thereof to one of an intake valve and an exhaust valve and supported for rocking motion on a rocker shaft, a second rocker arm supported for rocking motion on the rocker shaft and disposed adjacent the first rocker arm for being rotationally driven by a cam, a cylinder formed on one of the first and second rocker arms and a first piston mounted for sliding motion in the cylinder, a contacting projection provided in a projecting manner on the other one of the first and second rocker arms for contacting with the first piston, a return spring for biasing the first piston toward a contacting position at which the first piston contacts with the contacting projection, and a second piston disposed so to extend in parallel to the first piston at least when the first piston is at a non-contacting position and configured to displace, when hydraulic pressure is supplied from the hydraulic path thereto, the first piston to a non-contacting position, at which the first piston do not contact with the contacting projection, against the biasing force of the return spring.

Preferably, the second piston is formed so as to have a diameter smaller than that of the first piston.

Preferably, the second piston is provided in displacement in a direction away from the contacting projection.

The cylinder may be formed on the second rocker arm, and both of the first piston and the second piston may be disposed in the second rocker arm.

The first piston may be disposed in the first rocker arm while the second piston is disposed in the rocker shaft.

EFFECTS OF THE INVENTION

With the valve mechanism for an internal combustion engine of the present invention, there is an advantage that, by providing the second piston, the changeover time upon changeover of the first piston (particularly, changeover from the contacting position to the non-contacting position) can be decreased drastically.

Consequently, changeover between contacting and non-contacting between the first rocker arm and the second rocker arm can be carried out with certainty. Accordingly, such a situation can be avoided with certainty that the first piston and the contacting projection are placed into a semi-contacting state and thereafter the first piston is repelled by the contacting projection by reactive force upon driving of the valve on the way of changeover of the first piston. Further, there is an advantage that generation of collision sound or hitting sound between the first rocker arm and the cam arising from that the first piston is repelled can be suppressed and the durability of the valve system enhances drastically.

Further, at least when the first piston is at the non-contacting position (that is, when the first piston and the second piston contact with each other), since the first piston and the second piston extend in parallel to each other, all of the force of the first piston applied from the second piston acts as axial force while side force acting in a direction orthogonal to the axial direction does not occur. Accordingly, the first piston can be changed over effectively.

Further, in a state wherein a load acts upon the first and second pistons, since the first piston assumes the non-contacting position and the relative rocking motion does not occur between the two pistons, abrasion of the pistons can be avoided. Accordingly, the second piston can be formed from resin, aluminum or the like, and reduction in the weight of the second piston can be implemented.

Further, where the second piston is formed from any of such materials as just described, since the biasing force of the return spring can be reduced together with the reduction of the weight of the piston, the changeover load to the first piston can be decreased and, as a result, the changeover can be performed with certainty also with low hydraulic pressure which is used upon low speed rotation of the engine such as upon idling.

Further, where the second piston is formed so as to have a diameter smaller than that of the first piston, the oil amount necessary for changing over the first piston can be decreased drastically, and the changeover time upon changeover of the first piston can be decreased drastically.

Further, where the second piston is provided in a displaced relationship in a direction away from the contacting projection, a space when the first piston is changed over to the non-contacting position and the contacting projection miss swings can be formed easily.

Further, where the cylinder is formed in the second rocker arm and both of the first piston and the second piston are disposed in the second rocker arm, since usually no relative movement occurs between the first piston and the second piston, abrasion of the contacting portions of the first piston and the second piston can be prevented.

Further, by disposing the first piston in the first rocker arm and disposing the second piston in the rocker shaft, decrease of the inertial mass of the first rocker arm can be achieved and increase of the engine speed can be achieved easily.

DETAILED DESCRIPTION OF THE INVENTION

Figure 1:
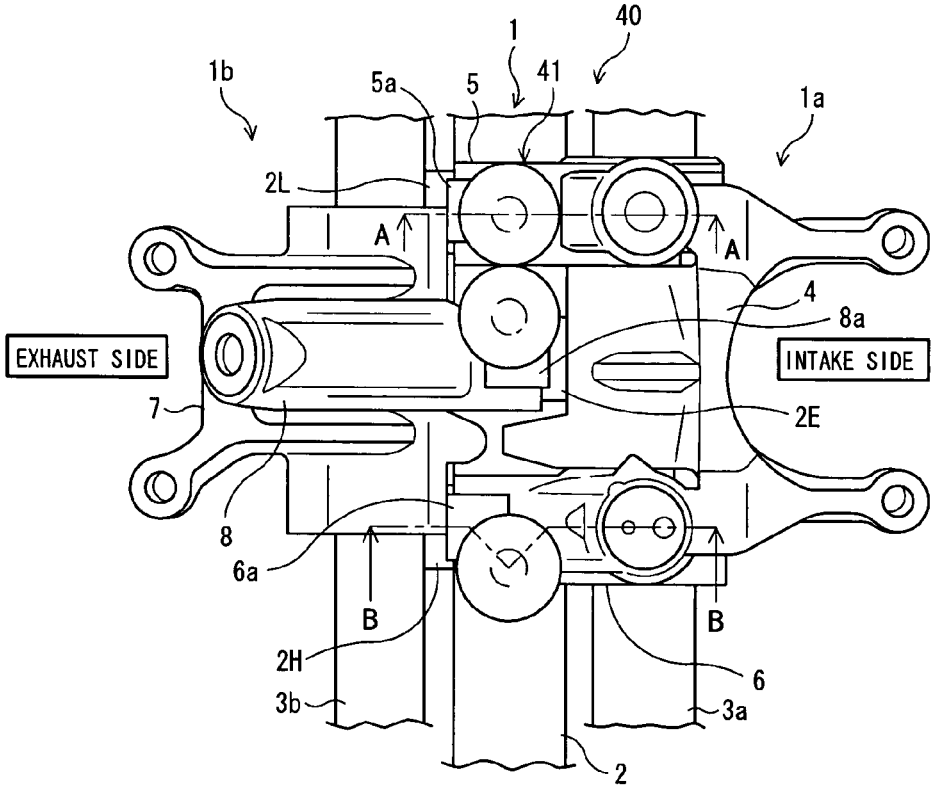
FIG. 1 is a schematic plan view showing a configuration of a valve mechanism for an internal combustion engine according to a first embodiment of the present invention.

In the following, a first embodiment of the present invention is described with reference to FIGS. 1 to 8. A cylinder head of an engine (internal combustion engine) includes, as described also in the background art, two intake valves and two exhaust valves for each of cylinders, and such a valve mechanism 1 as shown in FIG. 1 is mounted above the cylinders in order to drive the intake valves and the exhaust valves.

Figure 4:
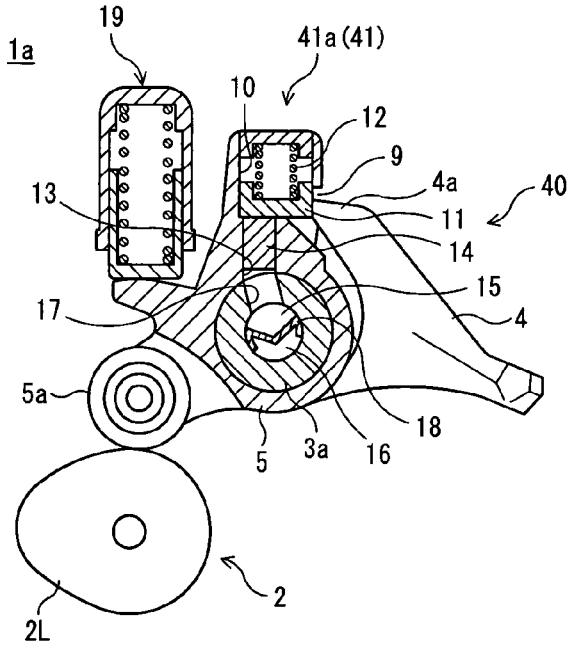
FIG. 4 is a schematic sectional view showing a structure of essential part of the valve mechanism for an internal combustion engine according to the first embodiment of the present invention and is a sectional view taken along line A-A of FIG. 1.
Figure 5:
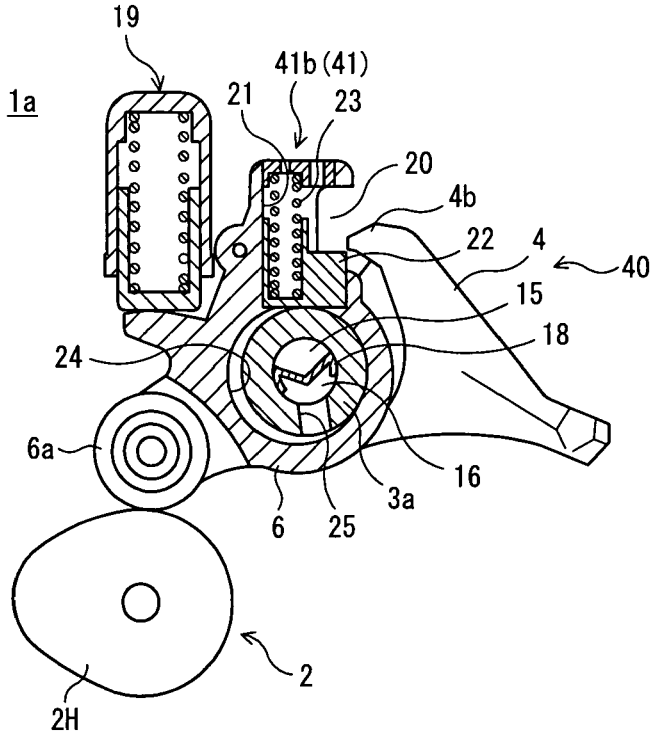
FIG. 5 is a schematic sectional view showing a structure of essential part of the valve mechanism for an internal combustion engine according to the first embodiment of the present invention and is a sectional view taken along line B-B of FIG. 1.

The valve mechanism 1 includes an intake valve driving system 1*a* for driving the intake valves and an exhaust valve driving system 1*b* for driving the exhaust valves. Further, as shown in FIGS. 4 and 5, the intake valve driving system 1*a* includes a camshaft 2, cams 2L and 2H (refer to FIGS. 4 and 5) fixedly provided on the camshaft 2, a rocker shaft 3*a*, and rocker arms 4 to 6 supported for rocking motion on the rocker shaft 3*a*.

Meanwhile, the exhaust valve driving system 1*b* includes the camshaft 2 commonly used with the intake system, a cam 2E fixedly provided on the camshaft 2, a rocker shaft 3*b*, and rocker arms 7 and 8 supported for rocking motion on the rocker shaft 3*b*.

A variable valve mechanism 40 having a connection changeover mechanism 41 is provided for each the intake valve driving system 1*a* and the exhaust valve driving system 1*b* of the valve mechanism 1. The variable valve mechanisms 40 are provided in order to change over the operational characteristic (opening and closing timing and lift amount of the valves) of the intake valves and the exhaust valves in response to the load state and the speed state of the engine.

The variable valve mechanism 40 on the intake valve side is configured such that it can change over among a low-speed driving mode wherein the intake valves are driven to open and close with an operational characteristic suitable for low-speed driving of the engine, a high-speed driving mode wherein the intake valves are driven to open and close with another operational characteristic suitable for high-speed driving of the engine and a cylinder cut-off driving mode wherein the intake valves are not operated.

Meanwhile, the variable valve mechanism 40 on the exhaust valve side is configured such that it can changeover between a normal driving mode wherein the exhaust valves not shown are driven to open and close at predetermined timings and a cylinder cut-off driving mode wherein the exhaust valves are not operated can be changed over to each other.

It is to be noted that, in the present embodiment, the variable valve mechanisms 40 having such a cylinder cut-off driving mode as described above are applied to those cylinders which correspond to one half of the cylinders of the engine, and a variable valve mechanism which does not have the cylinder cut-off mode (that is, a variable valve mechanism capable of changing over between the low-speed driving mode and the high-speed driving mode) is applied to those cylinders which correspond to the other half of the cylinders with regard to both of the intake valves and exhaust valves.

Next, the variable valve mechanism 40 on the intake valve side is described mainly with reference to FIGS. 1 and 3 to 5. The rocker arm (first rocker arm) 4 from among the rocker arms 4 to 6 for intake valve driving contacts at the top end thereof with the upper end of a stem of an intake valve not shown. Consequently, the intake valve can be opened and closed in response to the rocking motion of the rocker arm 4.

Further, the rocker arms (second rocker arms) 5 and 6 are disposed adjacent to the first rocker arm 4. Further, rollers 5*a* and 6*a* are provided at one end of the rocker arms 5 and 6, respectively, and the roller 5*a* contacts with the low-speed cam (first cam) 2L formed in a low-speed cam profile corresponding to low-speed driving of the engine. Accordingly, the rocker arm 5 can be rotationally driven by the low-speed cam 2L.

On the other hand, the roller 6*a* provided on the rocker arm 6 contacts with the high-speed cam (second cam) 2H formed in a high-speed cam profile corresponding to high-speed driving of the engine, and the rocker arm 6 is rotationally driven by the high-speed cam 2H. It is to be noted that the rocker arm 5 is hereinafter referred to as low-speed rocker arm 5 and the rocker arm 6 is hereinafter referred to as high-speed rocker arm 6. Further, the rocker arm 4 is hereinafter referred to as valve side rocker arm 4.

Figure 6:
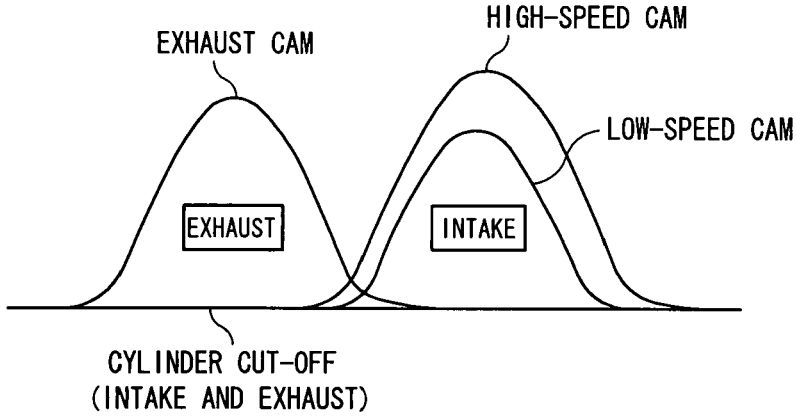
FIG. 6 is a view illustrating a valve-lift characteristic of the valve mechanism for an internal combustion engine according to the first embodiment of the present invention.

Further, as shown in FIG. 6, the characteristic of the cam profile of the high-speed cam 2H is set so as to include the cam profile of the low-speed cam 2L, and accordingly, the high-speed rocker arm 6 is usually rotationally driven by a greater amount than the low-speed rocker arm 5.

Now, the changeover mechanism (first connection changeover mechanism) 41*a* between the low-speed rocker arm 5 and the valve side rocker arm 4 is described mainly with reference to FIG. 4. A contacting projection 4*a* projecting to the low-speed rocker arm 5 side is formed at a position of the valve side rocker arm 4 opposed to the low-speed rocker arm 5, and another contacting projection 4*b* projecting to the high-speed rocker arm 6 side is formed at a position of the valve side rocker arm 4 opposed to the high-speed rocker arm 6.

Further, as shown in FIG. 4, a cylinder (first cylinder) 10 having an opening 9 is formed at a position of the low-speed rocker arm 5 opposed to the contacting projection 4*a*, and a piston 11 (first piston) is built in the cylinder 10. Further, a return spring 12 for biasing the piston 11 downwardly is provided between the cylinder 10 and the piston 11. It is to be noted that the shape of the opening 9 is not limited to that of the present embodiment, and whatever shape may be applied to the opening 9 only if a space within which the contacting projection 4*a* can be rotationally driven can be secured.

Further, a second cylinder 13 having a diameter smaller than that of the cylinder 10 is formed below the cylinder 10, and a pin (second piston) 14 formed so as to have a diameter smaller than that of the piston 11 is inserted in the second cylinder 13.

Here, the two cylinders 10 and 13 are formed such that the center axes thereof extend in parallel to each other, and as a result, the two pistons 11 and 14 are provided in parallel to each other in the low-speed rocker arm 4. Further, the pin 14 is provided in a displaced relationship in a direction away from the contacting projection 4*a* with respect to the piston 11.

Further, two oil grooves 15 and 16 are formed in the rocker shaft 3*a*, and the oil groove 15 is communicated with and connected to the second cylinder 13 through a communicating path 17. It is to be noted that the oil grooves 15 and 16 are formed by dividing a hole formed along the central axis of the rocker shaft 3*a* into two spaces by a plate-formed member 18, and operating oil (here, lubricating oil is used also as the operating oil) is supplied from a pressure oil source not shown to the oil grooves 15 and 16.

Accordingly, the pin 14 exhibits such a built-in state in the second cylinder 13 as shown in FIG. 4 when the operating oil pressure in the oil groove 15 is low, but if the operating oil pressure is raised, then the pin 14 is displaced to the first cylinder 10 side while maintaining the liquid sealing performance in the second cylinder 13.

Then, if the pin 14 is displaced in this manner, the upper end of the pin 14 contacts with the piston 11 to push the piston 11 upwardly against the biasing force of the return spring 12. Consequently, the piston 11 is driven to a position (non-contacting position) at which the opening 9 is open.

Further, if the hydraulic pressure in the oil groove 15 is released to decrease to the atmospheric pressure, then, as shown in FIG. 4, the piston 11 and the pin 14 are moved downwardly by the biasing force of the return spring 12 and the piston 11 comes to a position (contacting position) at which the opening 9 is closed up.

The first connection changeover mechanism 41*a* for changing over the connection state between the rocker arm 4 and the rocker arm 5 is formed from the piston 11 in the cylinder 10, the pin 14 for contacting with the piston 11 to change over the position of the piston 11 and the oil pressure adjustment apparatus (not shown) for adjusting the oil pressure in the oil groove 15.

Further, though not particularly shown, the sectional area of the communicating path 17 is set equal to that of the second cylinder 13 in order to drive the pin 14 rapidly or set greater than that of the second cylinder 13 taking the rocking motion of the rocker arm 5 into consideration.

It is to be noted that, since, if the pin 14 advances into the communicating path 17, then the relative rocking motion of the rocker arm 5 and rocker shaft 3*a* is hindered, the second cylinder 13 is formed so as to have a stepped structure in order to prevent advancement of the pin 14 into the communicating path 17. In particular, though not particularly shown, the second cylinder 13 has, in the proximity of the lower end thereof (that is, in the proximity of the opening with respect to the communicating path 17), a small diameter portion of a diameter a little smaller than that of the pin 14 and a great diameter portion of another diameter a little greater than the diameter of the pin 14 on the side above the small diameter portion. By such a configuration as just described, downward movement of the pin 14 farther than the small diameter portion is prevented. It is to be noted that, as a configuration different from such a configuration as described above, the advancement of the pin 14 may be prevented also by applying a configuration wherein the sectional shape of the pin 14 and the sectional shape of the communicating path 17 are different from each other.

By such a configuration as described above, if the oil pressure in the oil groove 15 is lowered, then the piston 11 is moved down by the biasing force of the return spring 12 to close up the opening 9 of the cylinder 10. Accordingly, if the low-speed rocker arm 5 is rotationally driven by the low-speed cam 2L, then the piston 11 and the contacting projection 4*a* at the one end of the rocker arm 4 are contacted with each other to rock the rocker arms 4 and 5 integrally with each other and the intake valves are driven to open and close with the characteristic corresponding to low-speed driving of the engine (low-speed driving mode).

On the other hand, if the oil pressure in the oil groove 15 is raised, then the pin 14 moves upwardly and the piston 11 moves upwardly against the biasing force of the return spring 12 until the opening 9 of the cylinder 10 is opened.

In this instance, if the low-speed rocker arm 5 rocks, then the contacting projection 4*a* advances into the opening 9 and the low-speed rocker arm 5 is placed into a so-called miss swing state (rocker arm non-contacting state) wherein the low-speed rocker arm 5 and the valve side rocker arm 4 do not contact with each other.

Accordingly, if the high-speed rocker arm 6 and the valve side rocker arm 4 are in a state separated from each other (this is hereinafter described), the valve side rocker arm 4 does not rock and the intake valves maintain a valve opening state independently of the phase of rotation of the cams 2L and 2H (cylinder cut-off driving mode).

It is to be noted that reference numeral 19 in FIGS. 4 and 5 denotes a spring mechanism (lost motion spring or arm spring) for biasing the low-speed rocker arm 5 and the high speed rocker arm 6 to follow up the cams 2L and 2H upon miss swing of the low-speed rocker arm 4 and high-speed rocker arm 5.

Next, the changeover mechanism (second connection changeover mechanism) 41*b* between the high-speed rocker arm 6 and the valve side rocker arm 4 is described mainly with reference to FIG. 5. As shown in FIG. 5, in the high-speed rocker arm 6, a cylinder 21 having an opening 20 is formed at a position opposed to the contacting projection 4*b*, and a piston 22 is built in the cylinder 21. Further, a return spring 23 for biasing the piston 22 downwardly is provided between the cylinder 21 and the piston 22.

Further, a lower portion of the cylinder 21 is communicated with and connected to an oil groove 24 formed in the high-speed rocker arm 6. Further, as shown in FIG. 5, the oil groove 24 is communicated with and connected to the oil groove 16 through a communicating path 25 formed in the rocker shaft 3*a*.

Further, the position of the piston 22 is changed over in response to a supplying state of the operating oil into the cylinder 21.

In particular, as shown in FIG. 5, when the working oil pressure in the oil groove 16 is low, the piston 22 is in a built-in state in the cylinder 21, but if the working oil pressure increases, then the piston 22 is displaced upwardly against the biasing force of the return spring 23. Then, at this time, the piston 22 closes up the opening 20.

In this instance, if the high-speed rocker arm 6 is rotationally driven by the high-speed cam 2H, then the contacting projection 4*b* of the rocker arm 4 is contacted with the piston 22 to rock the rocker arm 6 and rocker arm 5 integrally with each other. Accordingly, the intake valves are driven to open and close with the characteristic corresponding to the high-speed driving of the engine (high-speed driving mode).

On the other hand, if the hydraulic pressure in the oil groove 16 is released to decrease to the atmospheric pressure, then the piston 22 is moved downwardly by the biasing force of the return spring 23 to open the opening 20.

In this instance, if the rocker arm 6 rocks, then the contacting projection 4*b* advances into the opening 20 and is placed into a so-called miss swing state without contacting with the rocker arm 6 (rocker arm non-contacting state).

It is to be noted that the second connection changeover mechanism 41*b* for changing over the connection state between the rocker arm 4 and the rocker arm 6 is configured from the piston 22 described hereinabove and a hydraulic pressure adjustment apparatus (not shown) for adjusting the oil pressure in the oil groove 16, and the variable valve mechanism 40 on the intake side is configured from the second connection changeover mechanism 41*b*, first connection changeover mechanism 41*a* described above and intake valve driving system.

Figure 2:
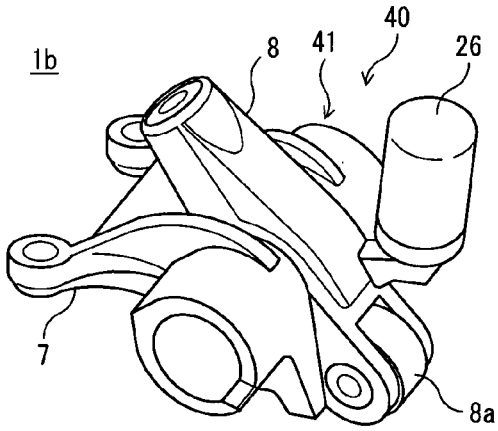
FIG. 2 is a schematic perspective view showing a configuration on the exhaust side of the valve mechanism for an internal combustion engine according to the first embodiment of the present invention.
Figure 3:
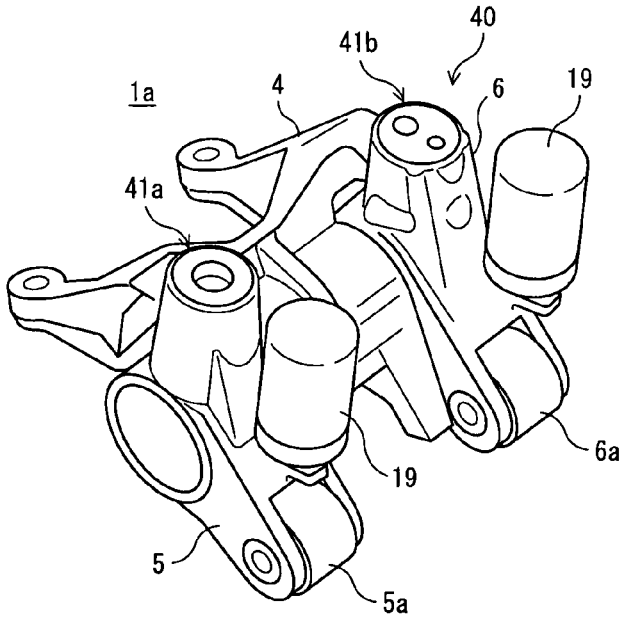
FIG. 3 is a schematic perspective view showing a configuration on the intake side of the valve mechanism for an internal combustion engine according to the first embodiment of the present invention.

Now, the variable valve mechanism 40 on the exhaust side is described. As shown in FIG. 2, the exhaust side valve apparatus 1*b* includes a valve side rocker arm 7 and a cam side rocker arm 8, and the communication state between the rocker arms 7 and 8 is changed over by the connection changeover mechanism 41.

Here, the exhaust side connection changeover mechanism 41 is configured similarly to the first connection changeover mechanism 41*a* on the exhaust side described above and has a structure substantially same as that shown in FIG. 4.

In particular, the exhaust side connection changeover mechanism 41 is configured such that it changes over between the normal driving mode wherein the valve side rocker arm 7 and the cam side rocker arm 8 are connected to each other so as to rock integrally with each other and the cylinder cut-off mode wherein the rocker arms 7 and 8 are disconnected from each other to prevent operation of the valve side rocker arm 7.

Further, the end of the valve side rocker arm 7 contacts with the upper end of the stem of the exhaust valves not shown, and, as a result, the exhaust valves are driven to open and close in response to the rocking motion of the rocker arm 7.

Further, the cam side rocker arm 8 is disposed adjacent to the valve side rocker arm 7 described above. Further, a roller 8*a* is provided at the lower end of the cam side rocker arm 8 and contacts with an exhaust cam 2E. Accordingly, the cam side rocker arm 8 is rotationally driven by the exhaust cam 2E.

It is to be noted that the exhaust cam 2E drives the exhaust valves to open and close within a wide driving region from low-speed driving to high-speed driving upon normal driving other than the cylinder cut-off driving. Therefore, as shown in FIG. 6, the cam profile of the exhaust cam 2E is set to an intermediate cam profile between the cam profile of the high-speed cam 2H and the cam profile of the low-speed cam 2L on the intake side.

Further, a contacting projection (not shown) projecting to the cam side rocker arm 8 side is formed at a position of the valve side rocker arm 7 opposed to the cam side rocker arm 8. Then, an opening is formed at a position opposed to the contacting projection just described similarly as in the first connection changeover mechanism 41*a* on the intake valve side, and, when the piston inserted in the cylinder is displaced, the opening is opened and closed (refer to FIG. 4).

Then, if the opening is opened, then the contacting projection described above advances into the opening and the cam side rocker arm 8 is placed into a miss swing state. Consequently, rocking movement of the cam side rocker arm 8 is not transmitted to the valve side rocker arm 7 and the exhaust valves are placed into a valve-closed state (cylinder cut-off driving mode).

On the other hand, if the opening is closed, then the contacting projection described above contacts with the piston to transmit the rocking movement of the cam side rocker arm 8 to the valve side rocker arm 7 so that the exhaust valves are driven to open and close (normal driving mode).

It is to be noted that, in FIG. 2, reference numeral 26 denotes a spring mechanism (lost motion spring or arm spring) for biasing the cam side rocker arm 8 to follow up the cam 2E upon non-contacting between the two rocker arm 7 and 8 (upon cylinder cut-off driving mode operation).

Further, while the exhaust side connection changeover mechanism 41 is configured similarly to the intake side first connection changeover mechanism 41*a* as described above, only the inside configuration of the rocker shaft 3*b* is different. In particular, while the oil groove in the rocker shaft 3*a* on the intake side is divided into two paths as shown in FIG. 4, the only one oil groove is provided in the rocker shaft 3*b* on the exhaust side (not shown).

This is because, on the exhaust side, the two connection changeover mechanisms 41*a* and 41*b* are not provided like the exhaust side connection changeover mechanism 41. In particular, since the first connection changeover mechanism 41*a* for changing over the driving mode between the low-speed driving mode and the cylinder cut-off driving mode and the second connection changeover mechanism 41*b* for changing over the driving mode between the high-speed driving mode and the low-speed driving mode are provided in the intake side connection changeover mechanism 41, two circuits of the hydraulic pressure supplying paths are necessitated. However, on the exhaust side, since only the single connection changeover mechanism 41 for changing over the driving mode between the normal driving mode and the cylinder cut-off driving mode is provided, only one circuit of the hydraulic pressure supplying path is provided in the rocker shaft 3*b*.

Incidentally, the supplying states of the operating oil in the oil grooves 15 and 16 in the rocker shaft 3*a* and the oil groove in the rocker shaft 3*b* can be controlled independently of each other by control means (ECU) not shown, and consequently, operation of the variable valve mechanism 40 (that is, operation of the connection changeover mechanisms 41 on the intake and exhaust sides) can be controlled.

Here, various sensors such as an engine speed sensor for detecting the engine speed, an engine load sensor for detecting the engine load and so forth are connected to the ECU, and the supplying states of the pressure oil in the rocker shafts 3*a* and 3*b* are changed based on the detection information from the sensors.

Figure 8:
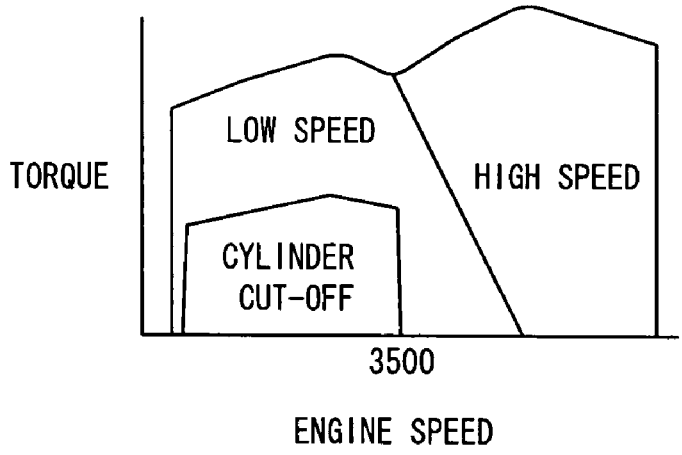
FIG. 8 is a map showing an operational characteristic of the valve mechanism for an internal combustion engine according to the first embodiment of the present invention.

Further, for example, such a map as shown in FIG. 8 is provided in the ECU. The map defines a cylinder cut-off region, a low-speed driving region and a high-speed driving region using the required torque (engine load) and the engine speed as parameters, and the operation of the connection changeover mechanisms 41 on the intake and exhaust sides is controlled such that the driving state of the engine coincides with the driving region set on the map.

For example, if the driving state of the engine is placed into the cylinder cut-off driving region (low load and low engine speed region except for idling) in FIG. 8, then the variable valve mechanisms 40 are set to the cylinder cut-off driving mode. In this instance, the operating oil is supplied into the oil groove 15 of the rocker shaft 3*a* on the intake side while the operating oil is drained through the oil groove 16. Further, the operating oil is supplied into the oil groove in the rocker shaft 3*b* on the exhaust side.

Consequently, in the variable valve mechanism 40 on the intake side, the piston 11 of the first connection changeover mechanism 41*a* moves upwardly and the piston 22 of the second connection changeover mechanism 41*b* moves downwardly to open the openings 9 and 20 formed at the positions opposed to the contacting projections 4*a* and 4*b* of the rocker arm 4.

Accordingly, even if the two rocker arms 5 and 6 are rotationally driven by the cams 2L and 2H, the pistons 11 and 22 do not contact with the contacting projections 4*a* and 4*b* of the rocker arm 4 and the rocker arms 5 and 6 are placed into a miss swing state, and the rocking motion of the rocker arm 4 is suspended to stop the operation of the intake valves.

On the other hand, in the variable valve mechanism 40 on the exhaust side, the cam side rocker arm 8 is placed into a miss swing state by an action similar to that of the first connection changeover mechanism 41*a* on the intake side and the rocking motion of the valve side rocker arm 7 is suspended to stop the operation of the intake valve.

Figures 7A, 7B, 7C:
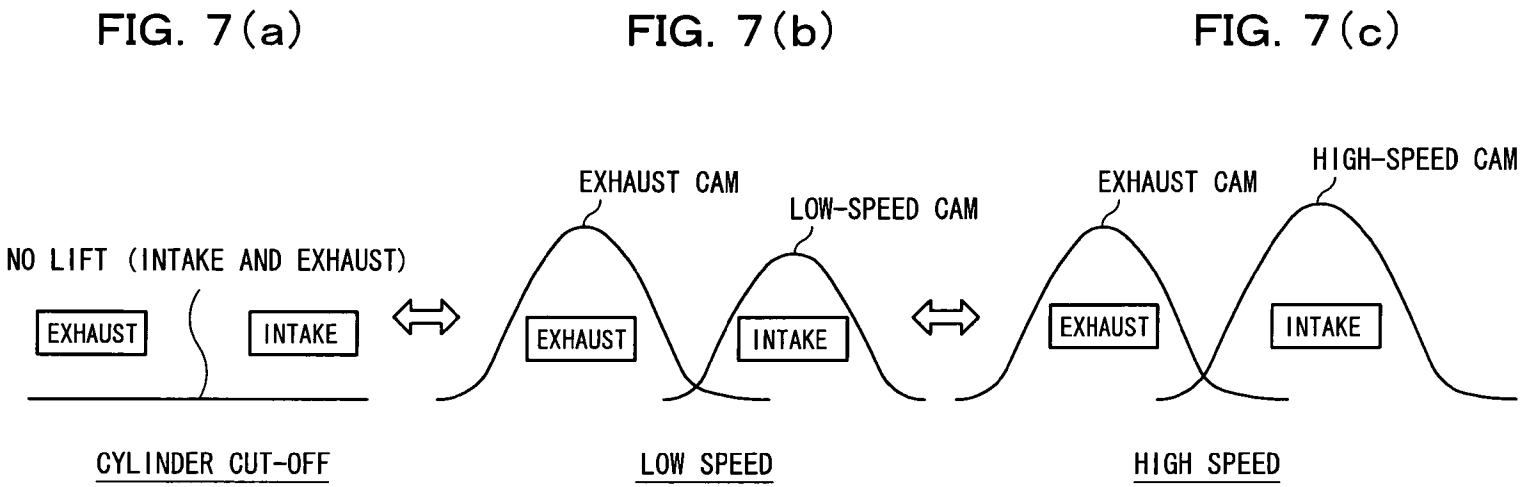
FIGS. 7(*a*) to 7(*c*) are views for illustrating the valve-lift characteristic of the valve mechanism for an internal combustion engine according to the first embodiment of the present invention, and wherein FIG. 7(*a*) illustrates the characteristic upon cylinder cut-off, FIG. 7(*b*) illustrates the characteristic upon low-speed driving and FIG. 7(*c*) illustrates the characteristic upon high-speed driving.

Consequently, as shown in FIG. 7(*a*), the valve lift amounts of both of the intake valves and the exhaust valves always exhibit 0 irrespective of the phase of the cams and the cylinder for which the variable valve mechanism 40 is provided exhibits the cylinder cut-off state (cylinder cut-off driving mode).

It is to be noted that, since, in the present embodiment, the variable valve mechanism 40 is provided for those cylinders which correspond to one half of all of the cylinders of the engine, the engine is driven with the one-half cylinders in such a cylinder cut-off driving mode as described above.

Further, in the low-speed driving region illustrated in FIG. 8, the operating oil in both of the oil groove 15 of the intake side rocker shaft 3*a* and the oil groove of the exhaust side rocker shaft 3*b* is drained. It is to be noted that, in the oil groove 16 of the intake side rocker shaft 3*a*, the draining state of the operating oil is maintained similarly as upon cylinder cut-off driving. Consequently, on the intake valve side, only the operating state of the first connection changeover mechanism 41*a* varies but the operating state of the second connection changeover mechanism 41*b* does not vary.

In particular, the piston 11 of the first connection changeover mechanism 41*a* operates to close up the opening 9. Accordingly, if the low-speed rocker arm 5 is rotationally driven, then the piston 11 contacts with the contacting projection 4*a* of the rocker arm 4 to transmit the rocking movement of the low-speed rocker arm 5 to the rocker arm 4 so that the intake valves are driven to open and close in accordance with the cam profile of the low-speed cam 2L.

Further, also on the exhaust valve side, the valve side rocker arm 7 and the cam side rocker arm 8 are integrally rotationally driven by an action similar to that of the first connection changeover mechanism 41*a*, and the exhaust valves are driven to open and close in accordance with the cam profile of the exhaust cam.

Consequently, as illustrated in FIG. 7(*b*), the operating characteristics of the intake valves and the exhaust valve are set to the valve timing characteristic suitable for low-speed driving (low-speed driving mode).

Further, if the driving state of the engine is placed into the high-speed driving region illustrated in FIG. 8, then the operating oil is supplied into the oil groove 16 of the intake side rocker shaft 3*a*. It is to be noted that, at this time, the draining state of the operating oil is maintained in the oil groove 15 of the intake side rocker shaft 3*a* and the oil groove in the exhaust side rocker shaft 3*b* similarly as in the low-speed driving mode.

Consequently, on the intake valve side, only the working state of the second connection changeover mechanism 41*b* varies but the working state of the first connection changeover mechanism 41*a* does not vary. In this instance, the high-speed rocker arm 6 and the rocker arm are integrally rotationally driven by the second connection changeover mechanism 41*b*, and the intake valves are driven to open and close in response to the cam profile of the high-speed cam 2H.

Accordingly, as shown in FIG. 7(*c*), the operating characteristics of the intake valves and the exhaust valves are set to the valve timing characteristic suitable for high-speed driving (high-speed driving mode).

Since the valve mechanism for an internal combustion engine as the first embodiment of the present invention is configured as described above, the driving mode can be changed over quickly in response to the driving state of the engine. Particularly, in the present apparatus, since the first connection changeover mechanism 41*a* is configured as a so-called two-step piston capable of changing over the position of the piston 11 in response to the displacement of the pin 14, changeover of the piston 11 can be executed with certainty.

In particular, even if hydraulic pressure is not generated directly on the bottom face of the piston 11, only if hydraulic pressure is generated on the bottom face of the pin 14 which is nearer to the oil groove, then the piston 11 can be changed over, and therefore, enhancement of the response upon changeover can be achieved.

Incidentally, where the piston 11 is operated to changed over directly by the hydraulic pressure, an amount of oil equal to the volume calculated from the product of the bottom area S1 (equivalent to the piston diameter R1) of the piston 11 and the piston stroke L is necessitated. On the other hand, if the necessary oil amount can be reduced upon changeover of the piston 11, then the changeover time of the piston 11 can be reduced. In other words, if the oil amount can be reduced, then since the piston 11 can be changed over with a reduced operating oil supplying amount, enhancement of the response upon changeover can be achieved.

However, taking the strength and so forth required for the piston 11 into consideration, further reduction in size of the diameter of the piston 11 and further reduction of the piston stroke are difficult, and, accordingly, it is difficult to reduce the oil amount necessary for the changeover of the piston 11.

Therefore, the two-step piston structure wherein the pin 14 having a small diameter is provided below the piston 11 is applied in the present invention. With such a configuration as just described, since the oil amount necessary for movement of the piston 11 becomes equal to the product of the bottom area S2 of the pin 14 (equivalent to the diameter R2 of the pin 14) and the stroke amount L, there is an advantage that, by setting the diameter of the pin 14 smaller than that of the piston 11, the changeover time of the piston 11 can be reduced.

Further, since, in the present first embodiment, both of two members of the piston (first piston) 11 and the pin (second piston) 14 are provided in the rocker arm 5, relative displacement or relative rocking motion does not occur between the two pistons 11 and 14. Accordingly, even if the top end of the pin 14 contacts with a bottom portion of the piston 11, a situation can be avoided wherein the top end of the pin 14 is abraded.

Further, since abrasion of the pin 14 does not occur, the pin 14 can be formed from resin or aluminum, and the weight of the pin 14 can be reduced. Consequently, further reduction of the changeover time can be achieved.

Further, by achieving reduction in weight of the pin 14, the biasing force of the return spring 12 can be reduced and, as a result, the changeover of the piston 11 can be carried out with low hydraulic pressure. Accordingly, even if comparatively low oil pressure (that is, upon low-engine speed driving) is used, the changeover of the piston 11 can be executed with certainty.

Further, since the two pistons 11 and 14 are arranged in parallel to each other, all of the force from the pin 14 acts in the axial direction of the piston 11 upon extension of the pin 14 but side force does not occur. Accordingly, reduction of the changeover time can be achieved also from such a point of view.

Further, since the pin 14 (second piston) is provided in a displaced relationship in a direction away from the contacting projection 4*a*, a space can be formed easily wherein the position of the first piston 14 is changed over to the non-contacting position to place the contacting projection 4*a* into a miss swing state.

Figure 9:
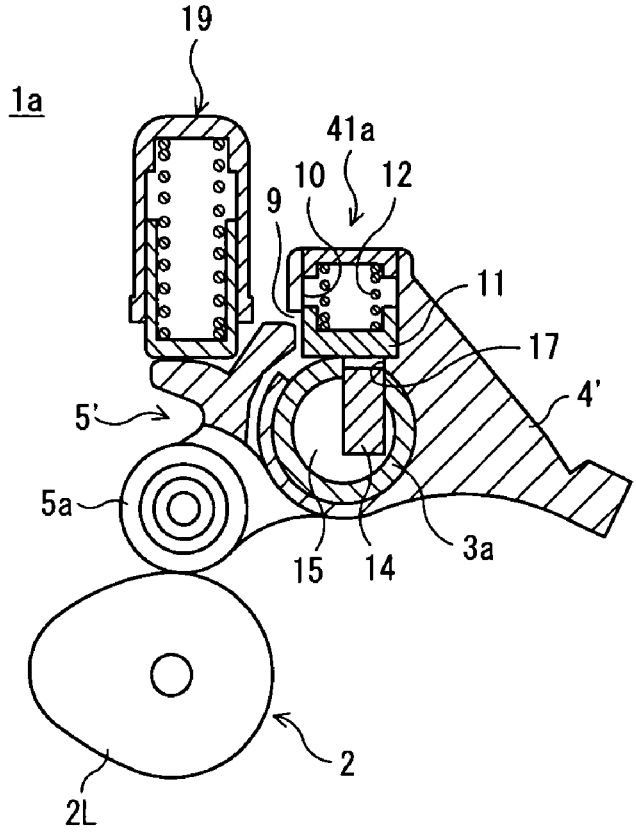
FIG. 9 is a schematic sectional view showing a structure of essential part of a valve mechanism for an internal combustion engine according to a second embodiment of the present invention and is a view corresponding to FIG. 4.
Figure 10:
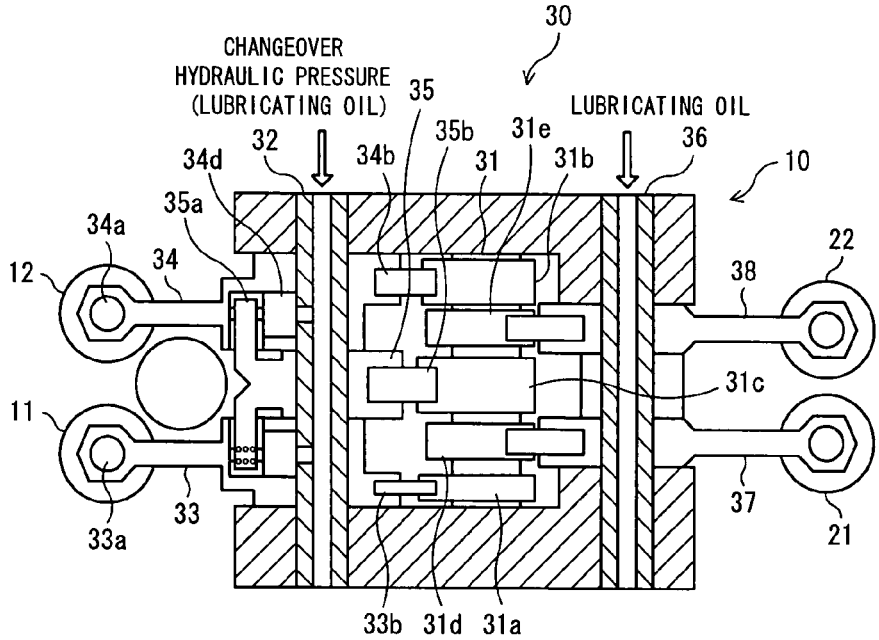
FIG. 10 is a view illustrating a conventional technique.
Figure 11:
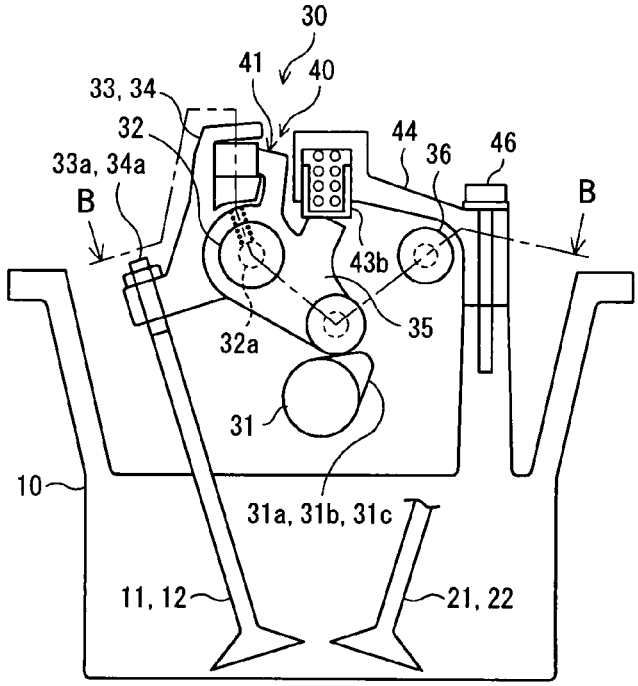
FIG. 11 is a view illustrating a conventional technique.
Figure 12A:
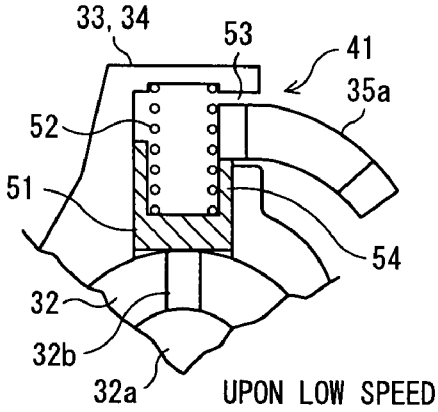
FIGS. 12(*a*) and 12(*b*) are views individually illustrating conventional techniques.
Figure 12B:
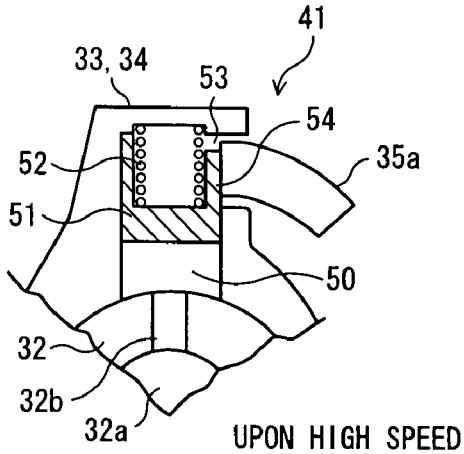

Now, a valve mechanism for an internal combustion engine according to a second embodiment of the present invention is described. As shown in FIG. 9, in the second embodiment, only the configuration of the first connection changeover mechanism 41*a* is different from that in the first embodiment, and the configuration other than that is similar as in the first embodiment. Therefore, mainly the portion different from that in the first embodiment is described, and like elements to those in the first embodiment are denoted by like reference characters and description thereof is omitted.

In the present second embodiment, as shown in FIG. 9, the piston 11 is provided for a valve side rocker arm 4' and the pin 14 is provided in the rocker shaft. In particular, the cylinder 10 having the opening 9 is formed on the valve side rocker arm 4' and the piston 11 (first piston) is built in the cylinder 10.

Further, a communication path 17 for connecting the oil groove 15 and the cylinder 11 in a communicating relationship with each other is formed in the rocker shaft 3*a* along a diametrical direction of the rocker shaft 3*a*. The pin 14 is disposed for back and forth movement in the communication path 17.

The piston 11 and the pin 14 are set such that the piston 11 and the pin 14 extend in parallel to each other at least in a non-contacting state wherein a cam side rocker arm 5' and a valve side rocker arm 4' do not contact with each other (that is, in a state wherein the roller 5*a* of the cam side rocker arm 5' contacts with a base circular portion of the cam 2L).

Since the valve mechanism according to the second embodiment of the present invention is configured in such a manner as described above, not only action and effects similar as in the first embodiment described above but also action and effects described below are obtained.

In particular, if the operating oil is supplied into the oil groove 15, then the pin 14 is displaced upwardly by the oil pressure and the piston 11 is displaced upwardly against the biasing force of the return spring 12 to open the opening 9 (non-contacting position). Consequently, even if the rocker arm 5' is rotationally driven, the rocker arm 5' misses swings and driving force of the rocker arm 5' is not transmitted to the rocker arm 4' and then the non-contacting state is entered wherein the two rocker arms 4' and 5' are disconnected from each other. At this time, while the pin 14 and the piston 11 contact with each other, since relative rocking motion does not occur between the pin 14 and the piston 11, abrasion of the pin 14 can be avoided.

Then, from the contacting state, if the operating oil in the oil groove 15 is drained, then the piston 11 is urged by the return spring 12 to displace downwardly to close up the opening 9 (contacting position). In this instance, the rocker arm 5' and the rocker arm 4' are rotationally driven integrally and the intake valves are opened and closed in accordance with the cam profile of the cam 2L (contacting state).

At this time, while the piston 11 rocks relative to the pin 14, the piston 11 and the pin 14 are disconnected from each other without contacting with each other, abrasion of the pin 14 can still be avoided.

Further, in order to change over from such a contacting state as described above to the non-contacting state again, pressure oil is supplied into the oil groove 15 at a timing at which the rocker arm 5' contacts with the base circular portion of the cam 2L. Consequently, since the pin 14 contacts with the piston 11 in a state wherein the pin 14 and the piston 11 extend in parallel to each other, similarly as in the first embodiment, all of the force of the piston 11 applied from the pin 14 acts as axial force while side force acting in a direction orthogonal to the axial direction does not appear. Accordingly, the piston 11 can be changed over efficiently.

Further, with the present second embodiment, since the pin 14 is provided in the rocker shaft 3*a* while only the piston 11 is provided in the rocker arm 4', the inertial mass of the rocker arm 4' can be decreased. Accordingly, there is an advantage that increase of the engine speed can be achieved easily and the engine power can be increased.

While preferred embodiments of the present invention and modifications to them have been described, the present invention is not limited to such embodiments and modifications, but the present invention can be carried out in various modified forms without departing from the spirit and scope of the present invention. For example, while, in the embodiments described above, the valve mechanism on the exhaust side is configured such that it can be changed over between the driving mode and the cylinder cut-off mode, the valve mechanism on the exhaust side may be configured similarly as in that on the intake side such that the driving mode can be changed over among the low-speed driving mode, high-speed driving mode and cylinder cut-off mode.

Further, the variable valve mechanisms on the intake side and the exhaust side may be configured such that it can change over between the low-speed driving mode and the high-speed driving mode, and the present invention may be applied to the changeover mechanisms for the driving modes.

The invention claimed is:

1. A valve mechanism for an internal combustion engine, comprising:

a first rocker arm linked and connected on a free end side thereof to one of an intake valve and an exhaust valve and supported for rocking motion on a rocker shaft;

a second rocker arm supported for rocking motion on said rocker shaft and disposed adjacent said first rocker arm for being driven to rock by a cam;

a cylinder formed on one of said first and second rocker arms and a first piston mounted for sliding motion in said cylinder;

a contacting projection provided in a projecting manner on the other one of said first and second rocker arms for contacting with said first piston;

a return spring for biasing said first piston toward a contacting position at which said first piston contacts with said contacting projection; and a second piston configured to displace, when hydraulic pressure is supplied thereto, said first piston to a non-contacting position, at which said first piston does not contact with said contacting projection, against the biasing force of said return spring, wherein said second piston is formed so as to have a diameter smaller than that of said first piston, and a center axis of said second piston is displaced from a center axis of said first piston in a direction away from said contacting projection.

2. The valve mechanism for an internal combustion engine as set forth in claim 1, wherein said second piston is disposed so as to extend in parallel to said first piston at least when said first piston is at a non-contacting position.

3. The valve mechanism for an internal combustion engine as set forth in claim 2, wherein said cylinder is formed on said second rocker arm, and both of said first piston and said second piston are disposed in said second rocker arm.

4. The valve mechanism for an internal combustion engine as set forth in claim 2, wherein said cylinder is formed on said first rocker arm and said first piston is disposed in said first rocker arm while said second piston is disposed in said rocker shaft.

5. The valve mechanism for an internal combustion engine as set forth in claim 1, wherein said rocker shaft has only a hole extending along a longitudinal direction thereof, and said hole is separated into two oil grooves by a plate-formed member provided inside said hole.

6. A valve mechanism for an internal combustion engine, comprising:

a first rocker arm linked and connected on a free end side thereof to one of an intake valve and an exhaust valve and supported for rocking motion on a rocker shaft;

a second rocker arm supported for rocking motion on said rocker shaft and disposed adjacent said first rocker arm for being driven to rock by a cam;

a cylinder formed on one of said first and second rocker arms and a first piston mounted for sliding motion in said cylinder;

a contacting projection provided in a projecting manner on the other one of said first and second rocker arms for contacting with said first piston;

a return spring for biasing said first piston toward a contacting position at which said first piston contacts with said contacting projection; and a second piston configured to displace, when hydraulic pressure is supplied thereto, said first piston to a non-contacting position, at which said first piston does not contact with said contacting projection, against the biasing force of said return spring, wherein said second piston is formed so as to have a diameter smaller than that of said first piston and provided in displacement in a direction away from said contacting projection, wherein said second piston is disposed so as to extend in parallel to said first piston at least when said first piston is at a non-contacting position, wherein said cylinder is formed on said first rocker arm and said first piston is disposed in said first rocker arm while said second piston is disposed in said rocker shaft.

* * * * *